US006823824B2

(12) United States Patent
Lee

(10) Patent No.: US 6,823,824 B2
(45) Date of Patent: Nov. 30, 2004

(54) ENGINE HAVING A VARIABLE COMPRESSION RATIO

(75) Inventor: Tae Kyoung Lee, Hwaseong (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/747,915

(22) Filed: Dec. 29, 2003

(65) Prior Publication Data

US 2004/0154561 A1 Aug. 12, 2004

(30) Foreign Application Priority Data

Oct. 2, 2003 (KR) ..... 10-2003-0068579

(51) Int. Cl.[7] ..... F02B 75/04

(52) U.S. Cl. ..... 123/48 B; 123/78 F

(58) Field of Search ..... 123/48 B, 78 F

(56) References Cited

FOREIGN PATENT DOCUMENTS

JP 58220926 A * 12/1983 ..... F02B/75/04
JP 2003-232233 8/2003

* cited by examiner

*Primary Examiner*—Noah Kamen
(74) *Attorney, Agent, or Firm*—Morgan Lewis & Bockius LLP

(57) ABSTRACT

A compression ratio of an engine is varied by changing a position of a crankshaft relative to a piston in accordance with an operational condition of the engine.

7 Claims, 3 Drawing Sheets

ENGINE HAVING A VARIABLE COMPRESSION RATIO

CROSS-REFERENCE TO RELATED APPLICATIONS

This application claims priority of Korean Application No. 10-2003-0068579, filed on Oct. 2, 2003, the disclosures of which are incorporated fully herein by reference.

FIELD OF THE INVENTION

Generally, the present invention relates to an engine. More particularly, the present invention relates to an engine that has a variable compression ratio.

BACKGROUND OF THE INVENTION

The compression ratio of an engine plays an important role in determining the output torque of the engine. The compression ratio is defined as a ratio of a combustion chamber volume C1 when a piston is at top dead center (TDC) to a combustion chamber volume C1+L1 when the piston is at bottom dead center (BDC). Here, L1 denotes a displacement of a cylinder.

Such a compression ratio can be formalized as the following equation 1.

$$\frac{C_1 + L_1}{C_1} \qquad \text{(Equation 1)}$$

According to the prior art, when a layout of an engine is designed, such a compression ratio is decided, and accordingly the engine is operated with the compression ratio in all its operating conditions. That is, according to the prior art, a compression ratio of an engine is fixed regardless of the engine operation conditions.

If a compression ratio of an engine can be varied in accordance with operational conditions of the engine, the performance thereof can be optimized with respect to various operating conditions.

For example, under a condition of a high compression ratio, it is preferable that ignition timing is advanced for maximizing output torque of the engine. However, the advance of ignition timing is limited by a possibility of knocking. Under a condition of a low speed and a low (or partial) load, it is preferable that the compression ratio is lowered for enhancing brake specific fuel consumption (BSFC) of the engine.

Therefore, if the compression ratio of an engine can be varied in accordance with operation conditions, enhancement of output power and fuel consumption in accordance with the operation conditions may be realized.

The information disclosed in this Background of the Invention section is only for enhancement of understanding of the background of the invention and should not be taken as an acknowledgement or any form of suggestion that this information forms the prior art that is already known in this country to a person of ordinary skill in the art.

SUMMARY OF THE INVENTION

Embodiments of the present invention provide an engine having non-limiting advantages of a variable compression ratio.

An exemplary engine having a variable compression ratio according to an embodiment of the present invention includes a guider formed above a main bearing supporting a crankshaft, a cylinder block having a connection portion for movably supporting the guider, an actuator disposed to the main bearing, for moving the main bearing in accordance with an operation condition of the engine such that the crankshaft is in-line with or offset from a reciprocating center of the piston, and an electronic control unit for operating the actuator.

In a further embodiment, the connection portion includes a guide groove within which the guider is movably engaged with.

In another embodiment, the actuator moves the main bearing to be offset from the reciprocating center of the piston when the operation conditions are low speed and low load, and the actuator moves the main bearing to be in-line with the reciprocating center of the piston when the operation conditions are high speed and high load.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

Figure 1:
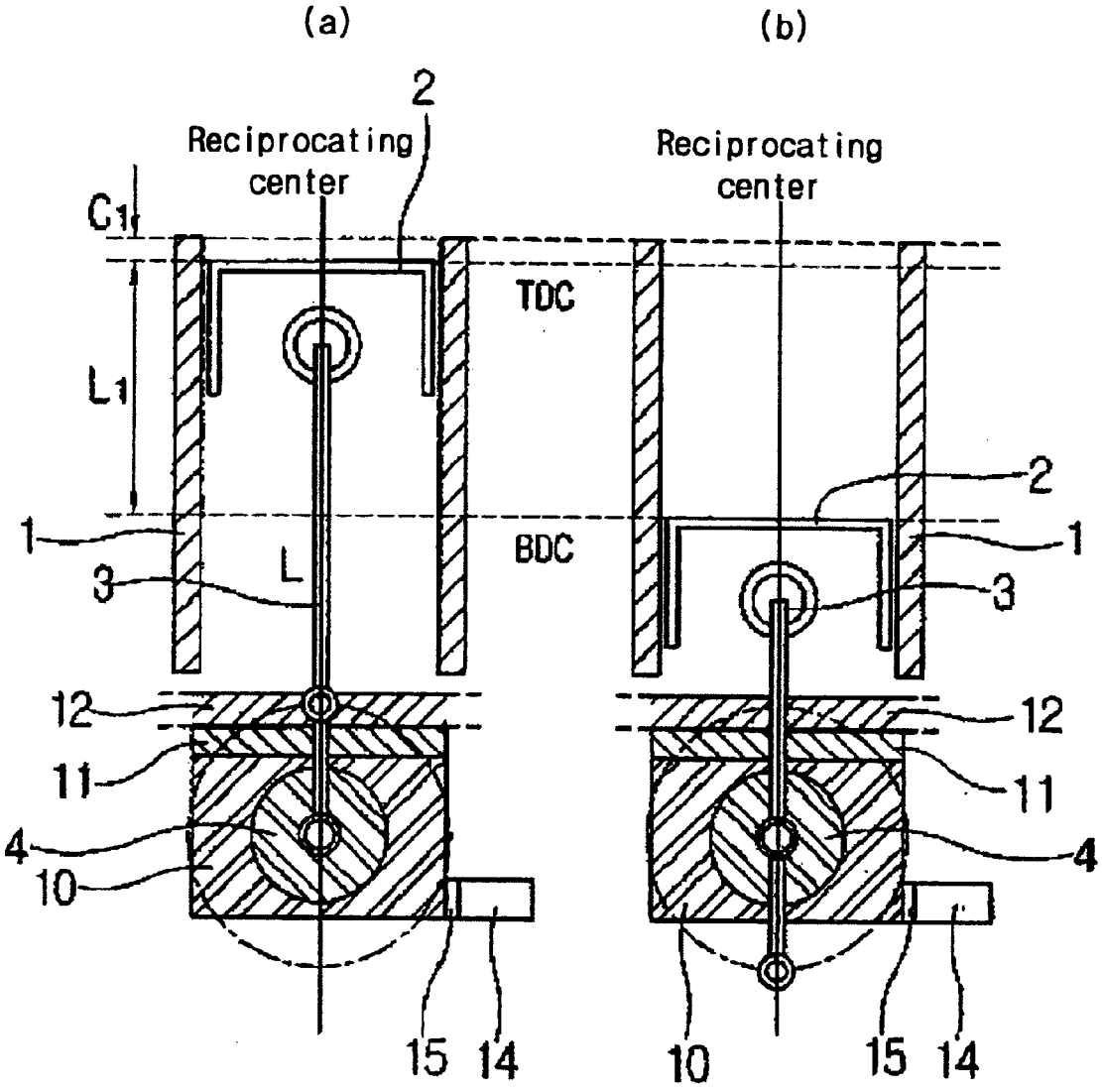
FIG. 1 illustrates an engine operating with a high compression ratio according to an embodiment of the present invention.

An embodiment of the present invention will hereinafter be described in detail with reference to the accompanying drawings.

An engine according to an embodiment of the present invention generally includes plural cylinders 1, with pistons 2 reciprocally disposed therein. Main bearing 10 supports a crankshaft 4. Connecting rods 3 interconnect the pistons 2 and crankshaft 4. The main bearing 10 is disposed to both sides of the crankshaft 4. A guider 11 is formed at an upper portion of the main bearing 10.

Figure 3:
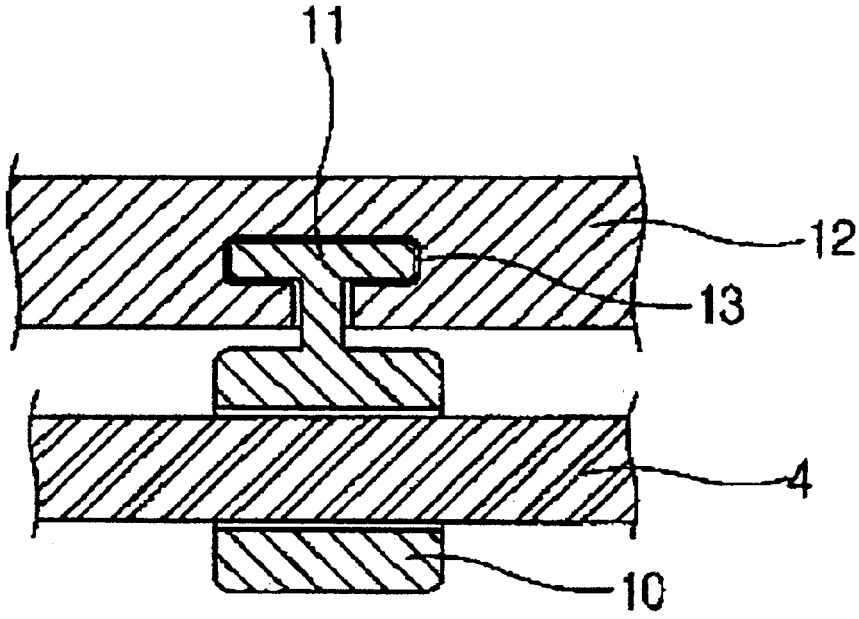
FIG. 3 illustrates an engagement of a main bearing to a cylinder block according to an embodiment of the present invention.

As shown in FIG. 3, a guide groove 13 is formed at a cylinder block 12 at which the main bearing 10 is mounted. The guider 11 is movably engaged with the guide groove 13 forming a sliding bearing, and therefore the main bearing 10 may laterally slide along the guide groove 13.

An actuator 14 is disposed to a side of the main bearing 10, for moving it e.g., by pushing and pulling it. The actuator 14 includes a piston 15 reciprocally operated by hydraulic pressure or pneumatic pressure. The piston 15 is firmly engaged with a side of the main bearing 10.

An operation of the actuator 14 is controlled by an electronic control unit 16 in accordance with the operational state of the engine. The electronic control unit may comprise a processor and other associated hardware and software as may be selected and programmed by a person of ordinary skill in the art based on the teachings contained herein.

When the engine is operated at high speed and high load conditions such that a high compression ratio is required, the piston 15 of the actuator 14 withdraws and pulls the main bearing 10 so that a center of the crankshaft 4 supported by the main bearing 10 becomes in line with a reciprocating center of the piston 2. Therefore, as shown in FIGS. 1(*a*) and 1(*b*), TDC and BDC of the piston 2 become as high as possible according to the design, and accordingly the compression ratio of the engine becomes a maximum, as measured by Equation 1.

Figure 2:
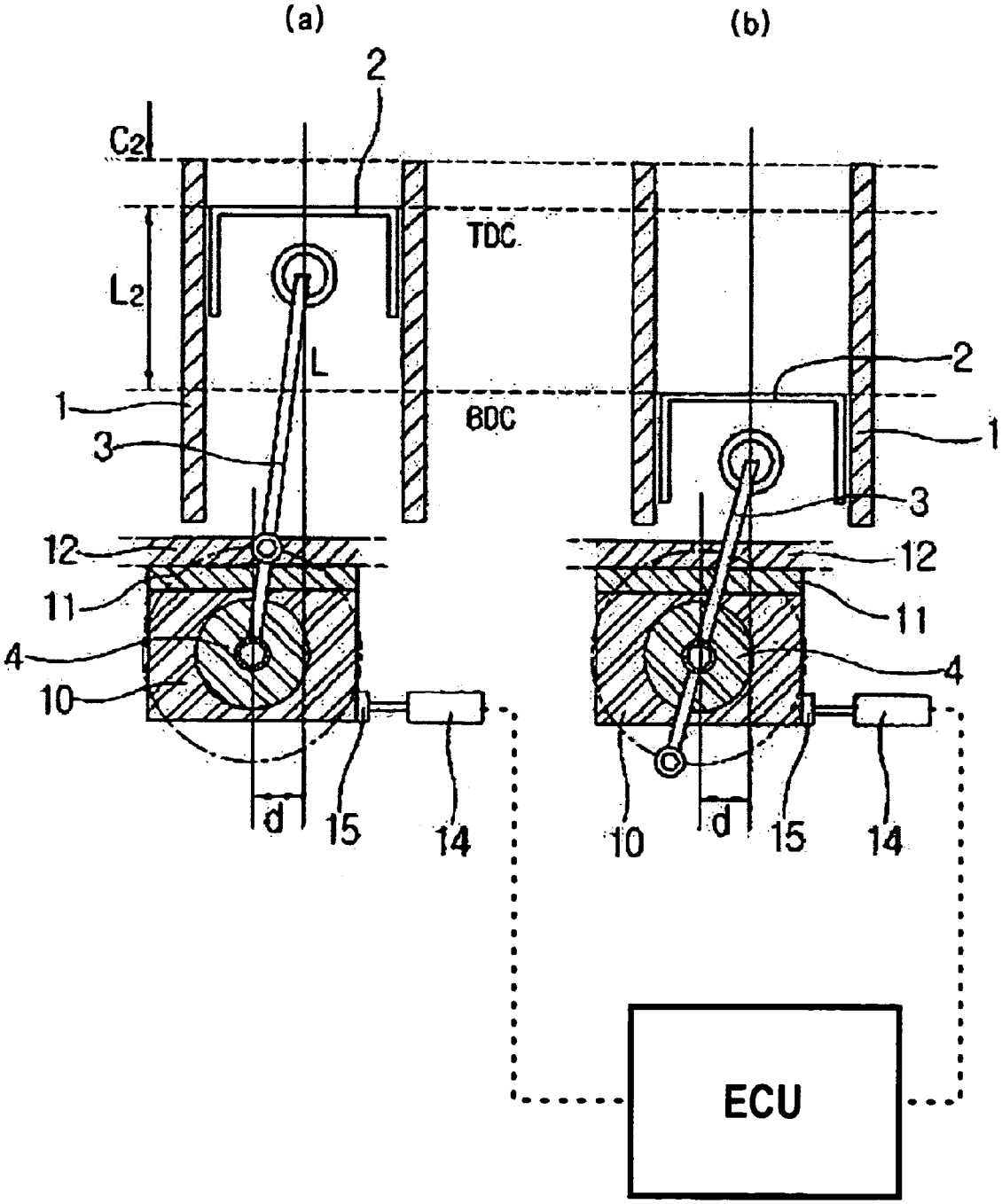
FIG. 2 illustrates an engine operating with a low compression ratio according to an embodiment of the present invention.

When the engine is operated at low speed and low (or partial) load conditions so that a low compression ratio is required, the actuator 14 pushes the main bearing 10 a predetermined distance d such that the center of the crankshaft 4 become offset from the reciprocating center of the piston 2, as shown in FIGS. 2(*a*) and 2(*b*). Therefore, TDC and the BDC of the piston 2 are lowered correspondingly to the moved distance d of the crankshaft 4, and accordingly the compression ratio of the engine becomes reduced since the combustion chamber formed at TDC becomes larger.

Reduction of the compression ratio by moving the crankshaft 4 from the reciprocal center of the piston 2 by the distance d can be formularized as follows:

A combustion chamber volume C2 with the piston 2 at TDC and a combustion chamber volume L2 with the piston 2 at BDC can be expressed as the following Equations 2 and 3.

$$L_2=\sqrt{(L+r)^{2-d^2}}-\sqrt{(L-r)^{2-d^2}} \quad \text{(Equation 2)}$$

$$C_2=C_1+(L+r)-\sqrt{(L+r)^{2-d^2}} \quad \text{(Equation 3)}$$

Here, L denotes a length of the connecting rod 3, r denotes a radius of rotation of the crankshaft 4 (i.e., a length of a crank arm), d denotes moved distance of the crankshaft 4, and C1 denotes a combustion chamber volume formed when the crankshaft is in line with the reciprocating center of the piston and the piston is at the TDC.

Therefore, an equation of the compression ratio of the engine can be obtained using the above formulae as the following Equation 4.

$$\frac{C_2+L_2}{C_2}=\frac{C_1+(L+r)-\sqrt{(L-r)^2-d^2}}{C_1+(L+r)-\sqrt{(L+r)^2-d^2}} \quad \text{(Equation 4)}$$

The above Equation 4 of the compression ratio becomes equal to the above Equation 1 when d=0 (i.e., when the crankshaft 4 becomes in line with the reciprocating center of the piston 2) since 2r equals L1.

When the distance d is positive (i.e., d>0), the calculation of Equation 4 becomes smaller than that obtained from Equation 1 so the compression ratio becomes less than the maximum compression ratio.

As described above, according to an embodiment of the present invention, the compression ratio of an engine can be varied in accordance with operational conditions of the engine. Therefore, performance and fuel consumption of an engine can be enhanced by varying its compression ratio.

Since the compression ratio can be varied when required, a maximum compression ratio of such an engine may be designed as high as possible. Therefore, an engine may have a smaller displacement than an engine of the prior art to produce the same output power, so weight of the engine and accordingly the weight of a vehicle can be decreased.

In addition, according to an embodiment of the present invention, variation of a compression ratio of an engine is achieved by a simple mechanical structure so an increase of weight and cost to attain a variable compression ratio is minimized.

While this invention has been described in connection with preferred embodiments, it is to be understood that the invention is not limited to the disclosed embodiments, but, on the contrary, is intended to cover various modifications and equivalent arrangements included within the spirit and scope of the appended claims.

What is claimed is:

1. An engine having a variable compression ratio, the engine comprising:

a guider formed above a main bearing supporting a crankshaft;

a cylinder block having a connection portion for movably supporting the guider;

at least one piston reciprocally disposed in the cylinder block; and an actuator disposed to the main bearing, for moving the main bearing in accordance with an operational condition of the engine such that the crankshaft is in line with or offset from a reciprocating center of the piston.

2. The engine of claim 1, further comprising an electronic control unit for operating the actuator.

3. The engine of claim 1, wherein the connection portion comprises a guide groove within which the guider is movably engaged.

4. The engine of claim 1, wherein:

the actuator moves the main bearing to be offset from the reciprocating center of the piston when the operational conditions are low speed and low load; and the actuator moves the main bearing to be in line with the reciprocating center of the piston when the operational conditions are high speed and high load.

5. An engine having a variable compression ratio, comprising:

a cylinder block defining at least one cylinder;

at least one piston reciprocally disposed in said at least one cylinder for movement along a reciprocating center line;

a crankshaft slideably disposed below said pistons for transverse movement with respect to said reciprocating center line; and a connecting rod connecting said at least one piston to said crankshaft.

6. The engine of claim 5, further comprising:

a sliding bearing mounted on the cylinder block; and a main bearing supporting the crankshaft carried by said sliding bearing.

7. The engine of claim 6, further comprising an actuator acting on the main bearing to control the transverse movement of the crankshaft.

* * * * *